US010236641B2

(12) United States Patent
Du et al.

(10) Patent No.: US 10,236,641 B2
(45) **Date of Patent: *Mar. 19, 2019**

(54) CONNECTOR WITH FRONT SIDE IDENTIFICATION RING COMMUNICATIVELY COUPLED WITH REAR SIDE LED

(71) Applicant: FOXCONN INTERCONNECT TECHNOLOGY LIMITED, Grand Cayman (KY)

(72) Inventors: Xiao-Bo Du, Kunshan (CN); Er-Dong Ma, Kunshan (CN); Peng Chen, Kunshan (CN); Chun-Ming Yu, Kunshan (CN); Guo-Hua Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/806,356

(22) Filed: Nov. 8, 2017

(65) Prior Publication Data

US 2018/0131140 A1 May 10, 2018

(30) Foreign Application Priority Data

Nov. 8, 2016 (CN) ..... 2016 2 1201591 U

(51) Int. Cl.
*H01R 13/46* (2006.01)
*H01R 13/717* (2006.01)

(52) U.S. Cl.
CPC ..... *H01R 13/7175* (2013.01); *H01R 13/7172* (2013.01); *H01R 13/465* (2013.01)

(58) Field of Classification Search
CPC ..... H01R 13/7175; H01R 13/717; H01R 13/7172; H01R 13/465
USPC ..... 439/490, 910, 541.5
See application file for complete search history.

(56) References Cited

U.S. PATENT DOCUMENTS 6,056,594 A * 5/2000 Ching ..... H01R 13/465 439/541.5
6,257,906 B1 * 7/2001 Price ..... H01R 13/60 439/131
6,508,665 B1 1/2003 Hon Hai
6,776,651 B1 * 8/2004 Liu ..... H01R 13/641 439/490

(Continued)

FOREIGN PATENT DOCUMENTS

TW 506674 10/2002
TW 568434 12/2003

(Continued)

*Primary Examiner* — Gary F Paumen
(74) *Attorney, Agent, or Firm* — Wei Te Chung; Ming Chieh Chang

(57) ABSTRACT

An electrical connector includes an insulative housing having a main body defining a plurality of mating cavities each coupled with an LED located right behind the mating cavity. A plurality of contacts are disposed in the housing corresponding to each of the mating cavities. A translucent color ring is assembled upon a front face of the main body of the housing in front of each mating cavity. A holder is attached upon a rear face of the housing behind the contacts. The LEDs and the corresponding connecting legs are retained by the holder.

20 Claims, 7 Drawing Sheets

(56) References Cited

U.S. PATENT DOCUMENTS

| | | | | |
|---|---|---|---|---|
| 6,910,917 | B2 * | 6/2005 | Chen | H01R 13/518<br>439/541.5 |
| 6,997,742 | B1 * | 2/2006 | Tung | H01R 13/514<br>439/101 |
| 7,029,329 | B1 * | 4/2006 | Huang | H01R 13/514<br>439/541.5 |
| 2004/0248464 | A1 * | 12/2004 | Xue | H01R 12/716<br>439/541.5 |
| 2006/0256556 | A1 * | 11/2006 | Huang | H01R 13/717<br>362/249.01 |
| 2007/0155223 | A1 * | 7/2007 | Huang | H01R 13/717<br>439/490 |
| 2010/0124842 | A1 * | 5/2010 | Bu | H01R 13/518<br>439/541.5 |
| 2013/0017715 | A1 * | 1/2013 | Laarhoven | H01R 13/717<br>439/490 |
| 2014/0213100 | A1 * | 7/2014 | Xuan | H01R 13/7175<br>439/490 |
| 2018/0131141 | A1 * | 5/2018 | Ma | H01R 13/7175 |

FOREIGN PATENT DOCUMENTS

| | | |
|---|---|---|
| TW | M258464 | 3/2005 |
| TW | M391214 | 10/2010 |
| TW | M254155 | 1/2015 |

* cited by examiner

CONNECTOR WITH FRONT SIDE IDENTIFICATION RING COMMUNICATIVELY COUPLED WITH REAR SIDE LED

BACKGROUND OF THE DISCLOSURE

1. Field of the Disclosure

The invention is related to an electrical connector, and particularly to the electrical connector equipped with an identification light device. The instant application relates to the copending application filed on the same day with the same applicant and titled with "CONNECTOR HAVING PCB WITH THEREOF LED COMMUNICATIVELY COUPLED WITH IDENTIFICATION RING".

2. Description of Related Arts

Taiwan Utility Patent No. M254755 discloses an electrical connector equipped with differently colored caps for identification use. Anyhow, when the circumstance is relatively dark, it is uneasy to correctly perceive the correct color for identification. Taiwan Utility Patent No. M391214 discloses an electrical connector equipped with the differently colored LEDs (Light Emitting Diode) for the dark use. Anyhow, such LEDs are assembled upon the front face of the housing, thus somewhat complicating the manufacturing process and the circuit paths on the printed circuit board.

It is desired to provide an electrical connector with the LEDs around the rear side of the housing for facilitating the manufacturing process and simplifying the circuit layout on the printed circuit board.

SUMMARY OF THE DISCLOSURE

To achieve the above desire, an electrical connector includes an insulative housing having a main body defining a plurality of mating cavities each coupled with an LED located right behind the mating cavity. A plurality of contacts are disposed in the housing corresponding to each of the mating cavities. A translucent color ring is assembled upon a front face of the main body of the housing in front of each mating cavity. A holder is attached upon a rear face of the housing behind the contacts. The LEDs and the corresponding connecting legs are retained by the holder.

DETAILED DESCRIPTION OF THE PREFERRED EMBODIMENT

Figure 1:
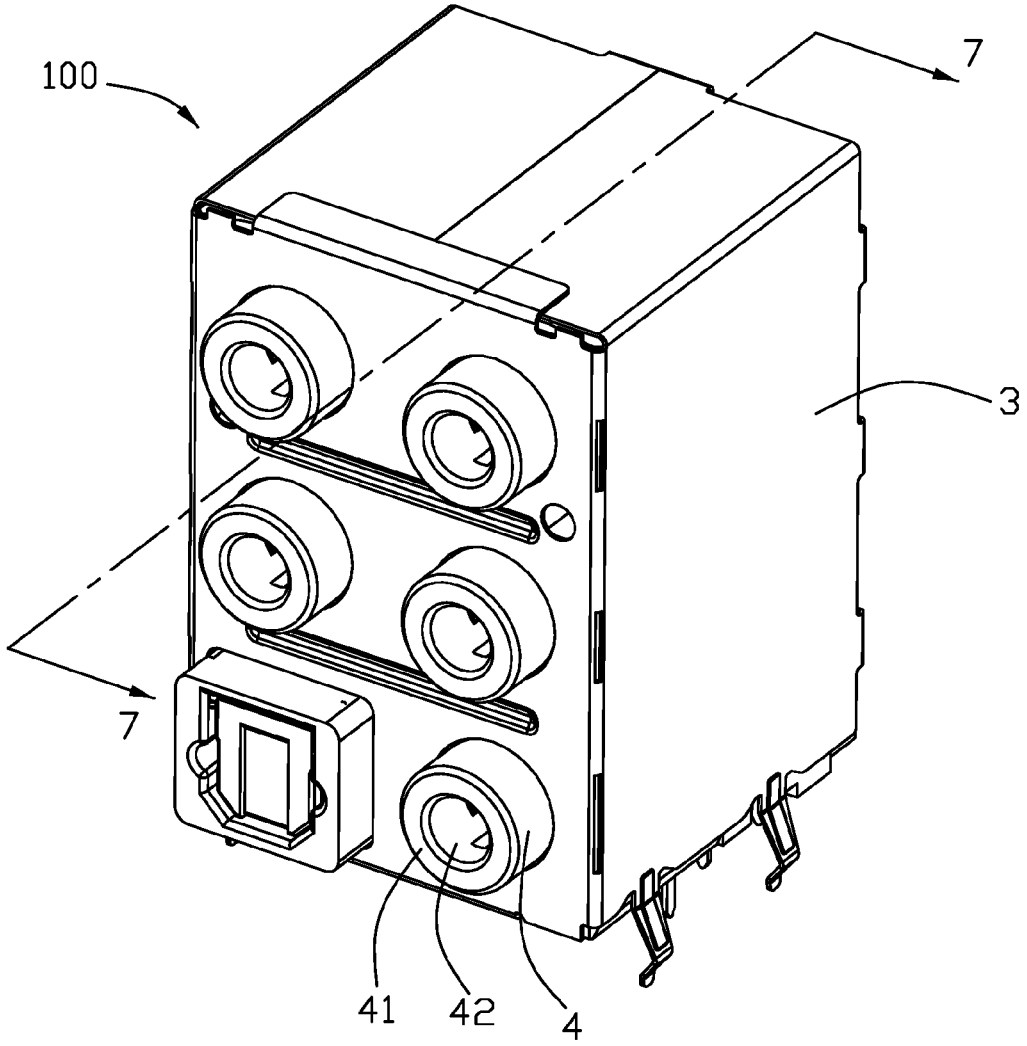
FIG. 1 is a perspective view of an electrical connector with according to the invention.
Figure 2:
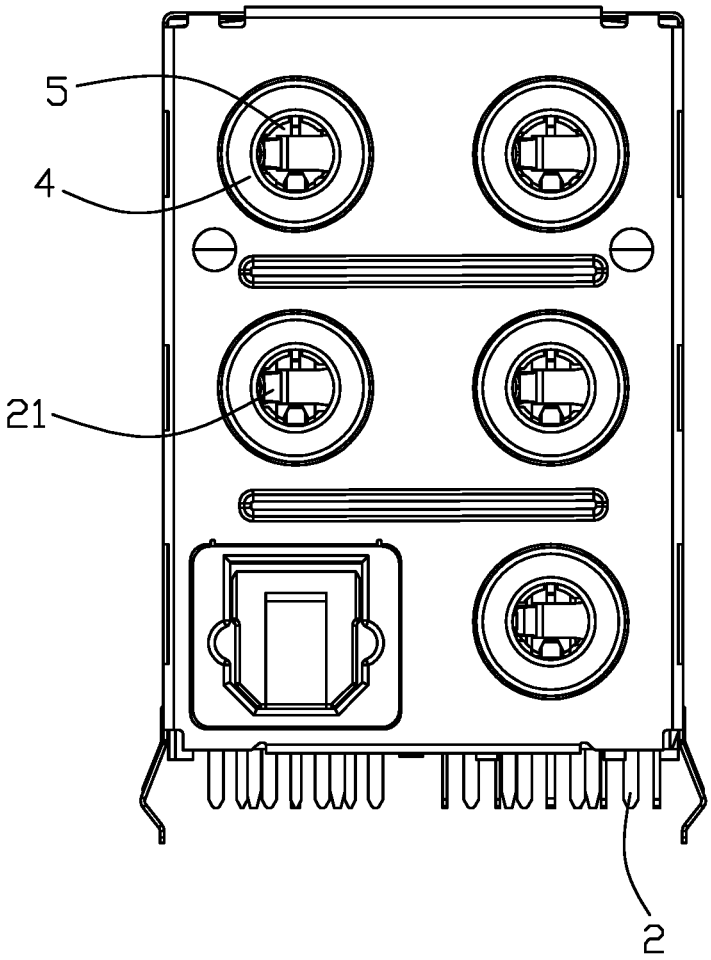
FIG. 2 is a front view of the electrical connector of FIG. 1.
Figure 3:
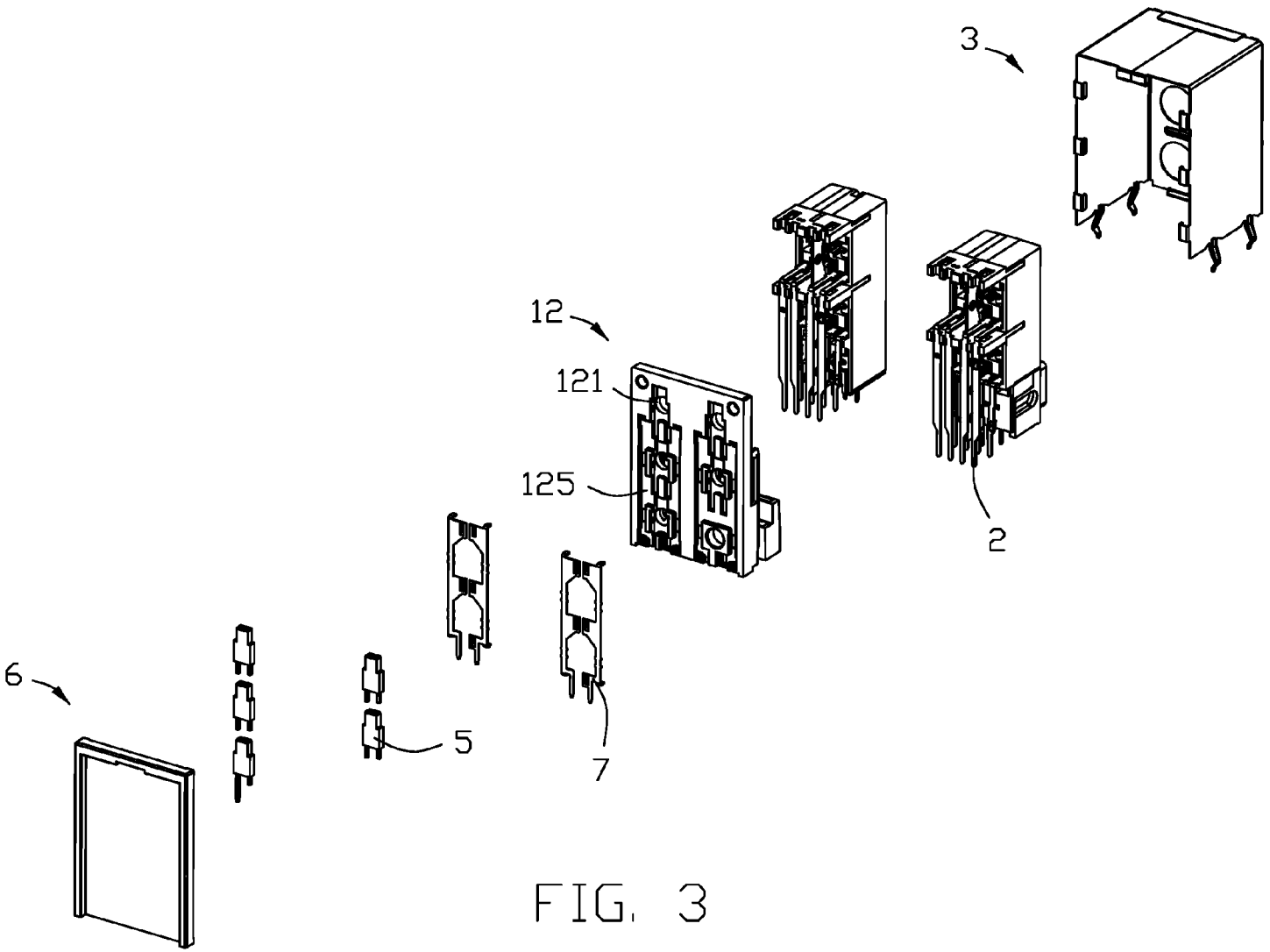
FIG. 3 is an exploded perspective view of the electrical connector of FIG. 1.
Figure 4:
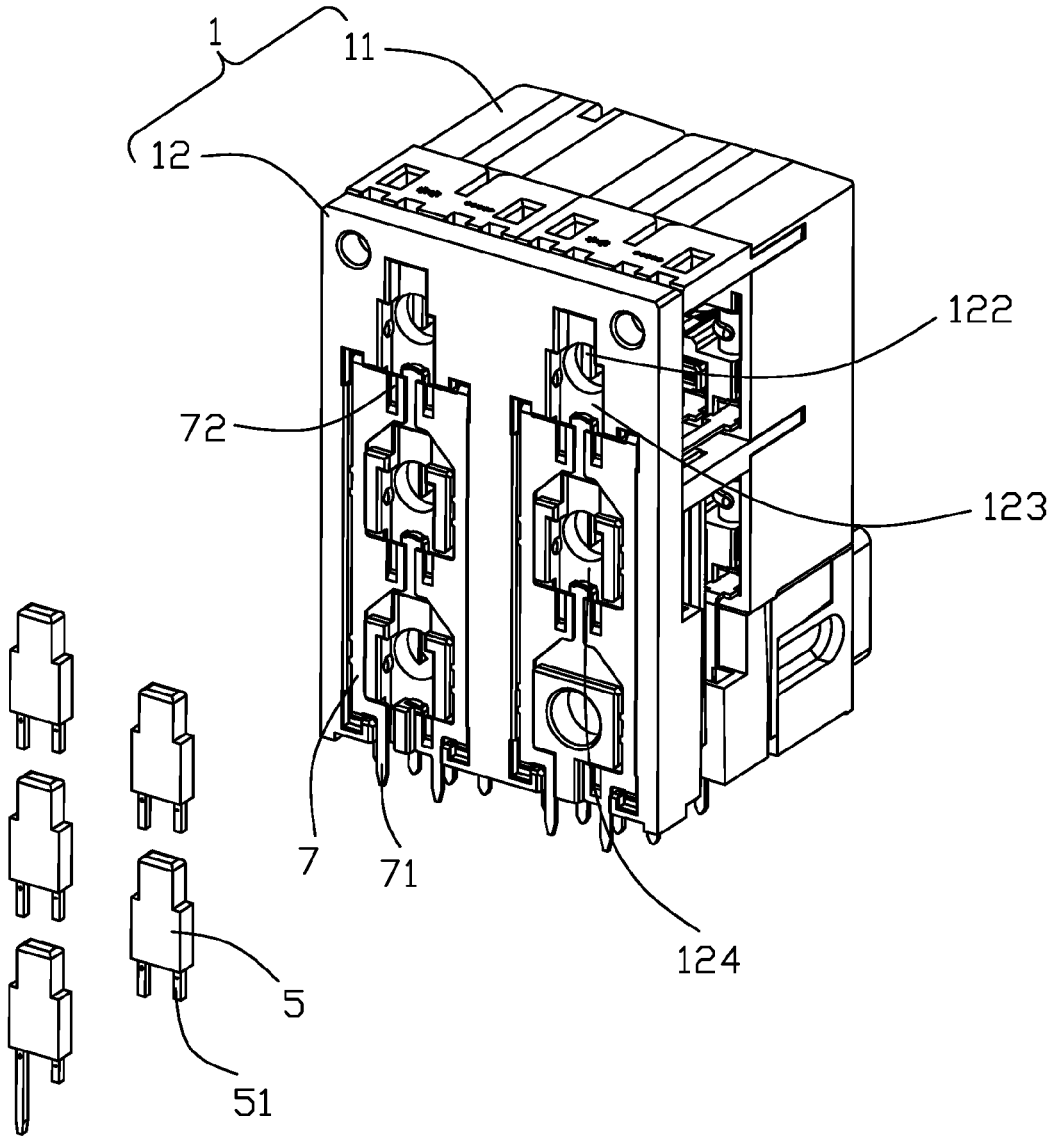
FIG. 4 is a rear perspective view of the electrical connector of FIG. 1 without showing the shield wherein the LEDs are moved away from the spacer.
Figure 5:
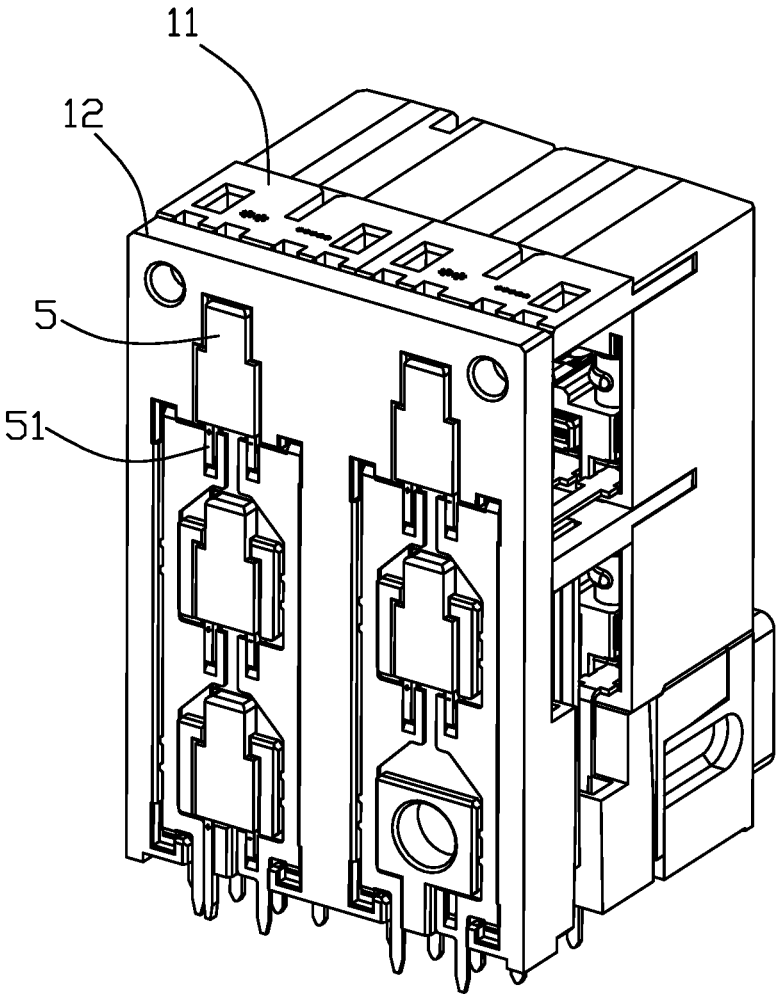
FIG. 5 is a rear perspective view of the electrical connector of FIG. 4 wherein the LEDs are retained in the spacer.
Figure 6:
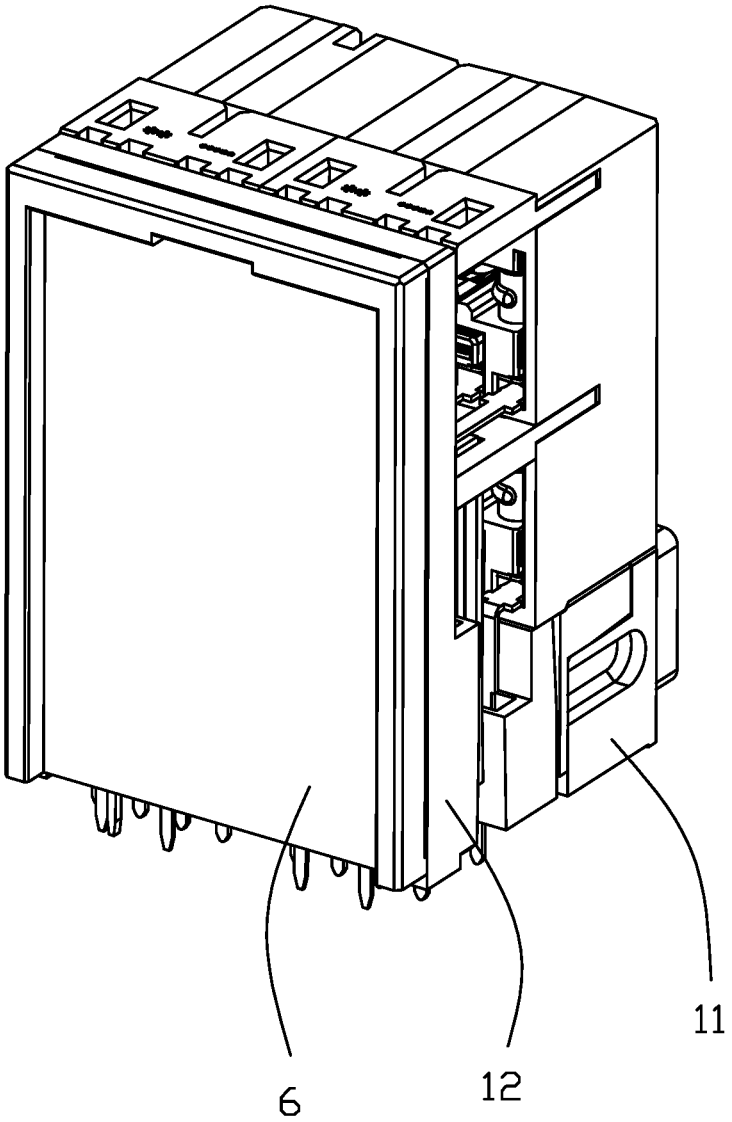
FIG. 6 is a rear perspective view of the electrical connector of FIG. 5 wherein the rear insulative cover is attached upon the spacer.
Figure 7:
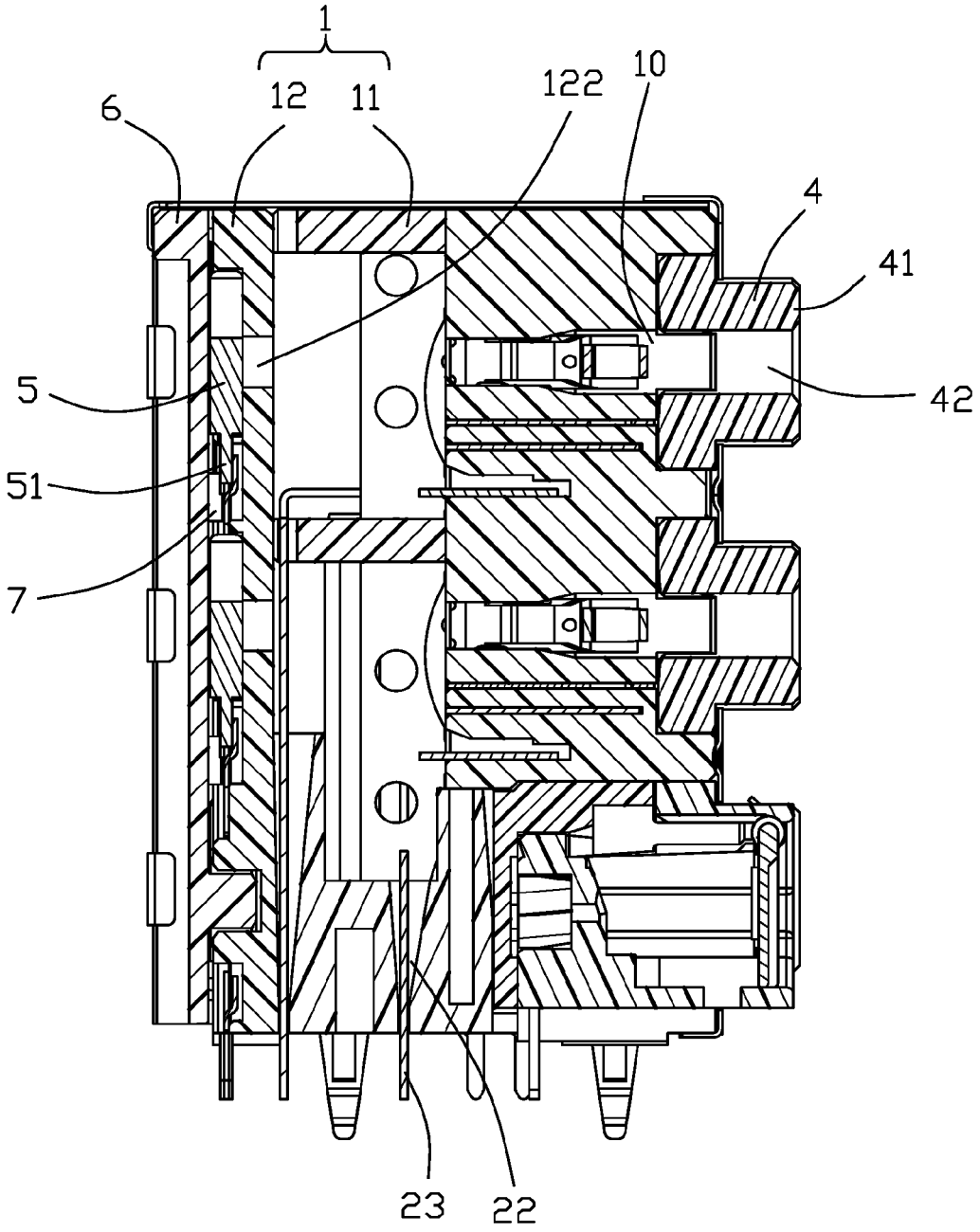
FIG. 7 is a cross-sectional view of the electrical connector of FIG. 1 to show the LED is right behind the corresponding mating cavity.

Reference will now be made in detail to the embodiments of the present disclosure. Referring to FIGS. 1-7, an electrical card connector 100 includes an insulative housing 1 defining a plurality of mating cavities 10, a plurality of contacts 2 disposed in the housing 1 around each mating cavity 10, a plurality of mating rings or parts 4 attached upon the front face of the housing 1 and respectively aligned in front of the corresponding mating cavities 10, a plurality of LEDs or light devices 5 located behind the corresponding mating ring 4, an insulative rear cover 6 located behind and covering the LEDs 5, and a metallic shield 3 covering the housing 1 and the rear insulative cover 6. The mating ring 4 forms a mating face 41 and a mating opening 42 rearwardly communicating with the corresponding mating cavity 10 and forwardly extend through the mating face 41 in the front-to-back direction for allowing a corresponding plug connector to be inserted thereinto to reach the corresponding mating cavity 10. The mating ring 4 are essentially translucent/transparent and differently colored.

When no plug is inserted into the mating cavity 10 through the mating ring 4, the light may forwardly spread to be viewable through the colored mating ring 4 for efficient identification. When the plug is inserted into the mating cavity 10 through the mating ring 4, some light is still escape from the gap between the plug and the housing 1 so as to be viewable in front of the connector 100 for the identification purpose notably.

The housing 1 includes a front main body 11 and a rear holder/spacer 12 assemble with each other. The mating ring 4 is mounted upon and the mating cavities 10 are formed within the main body 11. The contact 2 includes a contacting section 21 exposed in the mating cavity 10, a mounted section 23 exposed outside the housing 1, and a retaining section 23 located between the contacting section 21 and the mounting section 23 and retained to the holder 12. The LEDs 5 are mounted upon the holder 12. A mounting groove 12 is formed in the holder 12 and includes through holes 122 extending through the front face of the holder 12 and aligned with the corresponding mating cavity 10, and mounting holes 123 in the rear face of the holder behind the corresponding through holes 122 with corresponding mounting face 124 thereon for receiving the corresponding LEDs 5 therein.

The holder 12 further includes a connecting groove 125 communicating with the mounting groove 12. A pair of conductive connecting parts 7 are received in the connecting groove 125, and includes mounting legs 71 extending outside of the housing 1, and receiving slots 72 in which the conductors 51 of the corresponding LEDs 5 are received. Therefore, through the pair of conductive connecting parts 7, the LED 5 may electrically connected to the printed circuit board (not shown) on which the connector 100 is mounted.

In assembling, the contacts 2 are assembled to the main body 11, the holder 12 associatively retains the contacts 2, the LEDs 5 associated with the connecting parts 7 are retained in the corresponding mounting holes 123 of the holder 12, the insulative rear cover 6 is attached behind the holder 12 to cover the LEDs 5, and the metallic shield 3 further covers the housing 1 and the rear cover 6.

While a preferred embodiment in accordance with the present disclosure has been shown and described, equivalent modifications and changes known to persons skilled in the art according to the spirit of the present disclosure are considered within the scope of the present disclosure as described in the appended claims. For example, the LED may not be located right behind the mating cavity in the front-to-back direction, and the main body may, beside the mating cavity, form the additional through hole along the front-to-back direction in alignment with the LED in the front-to-back direction as long as such a through hole is located behind the mating ring in the front-to-back direction.

What is claimed is:

1. An electrical connector comprising:

an insulative housing;

a plurality of mating cavities formed in the housing for receiving corresponding plugs therein, respectively;

a plurality of contacts disposed in the housing, each of said contacts including a front mating section exposed in the corresponding mating cavity; and a plurality of LEDs (Light Emitting Diodes) positioned on a rear side of the housing and respectively aligned with the mating cavities in a front-to-back direction so as to allow light to be forwardly exposed to an exterior via the corresponding mating cavities in said front-to-back direction.

2. The electrical connector as claimed in claim 1, wherein a plurality of mating parts are assembled upon a front face of the housing and respectively essentially aligned with the corresponding mating cavities, and each of said mating parts is translucent or transparent.

3. The electrical connector as claimed in claim 2, wherein said mating parts are differently colored.

4. The electrical connector as claimed in claim 2, wherein each mating part defines a mating hole rearwardly communicating with the corresponding mating cavity in the front-to-back direction.

5. The electrical connector as claimed in claim 1, wherein said housing includes a front main body and a rear holder, and the mating cavities are formed in the main body while the LEDs are mounted upon the holder.

6. The electrical connector as claimed in claim 5, wherein each of said contacts further includes a retaining section retained by the holder.

7. The electrical connector as claimed in claim 6, wherein each of said contacts further including a mounting section extending from the corresponding retaining section and exposed outside of the housing.

8. The electrical connector as claimed in claim 5, further including a plurality of conductive parts mechanically and electrically connected to conductors of the corresponding LEDs.

9. The electrical connector as claimed in claim 8, wherein the conductive parts are assembled upon the holder.

10. The electrical connector as claimed in claim 9, further including an insulative rear cover to cover the LEDs and the conductive parts.

11. The electrical connector as claimed in claim 10, further including a metallic shield covering both the housing and the rear cover.

12. An electrical connector comprising:

an insulative housing;

a plurality of mating cavities formed in the housing for receiving corresponding plugs therein, respectively;

a plurality of contacts disposed in the housing, each of said contacts including a front mating section exposed in the corresponding mating cavity;

a plurality of mating rings mounted upon a front face of the housing and defining a mating hole communicatively aligned with the corresponding mating cavities in a front-to-back direction, respectively, said mating ring being translucent or transparent; and a plurality of LEDs (Light Emitting Diodes) positioned on a rear side of the housing and respectively aligned with and located behind the mating cavities in the front-to-back direction; wherein light derived from the corresponding LEDs is emitted, through the mating cavity, to the corresponding mating ring for viewable identification.

13. The electrical connector as claimed in claim 12, wherein the light is emitted through the corresponding mating cavity and mating hole toward the corresponding mating ring.

14. The electrical connector as claimed in claim 13, wherein the housing includes a front main body and a rear holder, and said mating cavities are formed in the main body while said LEDs are assembled upon the holder.

15. The electrical connector as claimed in claim 14, wherein each of said contacts further includes a retaining section secured to the holder, and a mounting section downwardly extending from the retaining section outside of the holder.

16. The electrical connector as claimed in claim 14, further including a plurality of conductive parts retained to the holder to mechanically and electrically connected to conductors of the corresponding LEDs.

17. An electrical connector comprising:

an insulative housing including a front main body and a rear holder in a front-to-back direction;

a plurality of mating cavities formed in the main body for receiving corresponding plugs therein, respectively;

a plurality of contacts disposed in the housing, each of said contacts including a front mating section exposed in the corresponding mating cavity;

a plurality of mating parts mounted upon a front face of the housing around the corresponding mating cavities, respectively, said mating part being translucent or transparent; and a plurality of LEDs (Light Emitting Diodes) aligned with and located behind the corresponding mating cavities in a front-to-back direction, respectively, and a plurality of conductive connecting parts positioned on the holder; wherein light derived from the LED is forwardly transmitted, via the mating cavity, toward the corresponding mating part in said front-to-back direction.

18. The electrical connector as claimed in claim 17, wherein each of the mating parts forms a mating hole forwardly in alignment with the corresponding mating cavity in the front-to-back direction.

19. The electrical connector as claimed in claim 17, wherein each of said contacts includes a retaining section retained to the holder.

20. The electrical connector as claimed in claim 17, further including an insulative rear cover behind the holder, the LEDs and the conductive parts in the front-to-back direction.

* * * * *